US005138382A

United States Patent [19]

Van Duser et al.

[11] Patent Number: 5,138,382

[45] Date of Patent: Aug. 11, 1992

[54] APPARATUS AND METHOD FOR CREATING A DEVELOPER HOUSING SEAL VIA A CURTAIN OF CARRIER BEADS

[75] Inventors: Jack E. Van Duser, Webster; Ronald A. Fraser, Rochester; Frank V. Onorati, Rochester; Carl F. Oresick, Rochester, all of N.Y.

[73] Assignee: Xerox Corporation, Stamford, Conn.

[21] Appl. No.: 676,024

[22] Filed: Mar. 27, 1991

[51] Int. Cl.[5] ..... G03G 21/00

[52] U.S. Cl. ..... 355/215; 118/658; 355/305; 355/269

[58] Field of Search ..... 118/652, 658; 355/215, 355/245, 251, 253, 305, 269, 270

[56] References Cited

U.S. PATENT DOCUMENTS

| | | | |
|---|---|---|---|
| 3,809,012 | 5/1974 | Delvechio | 118/637 |
| 3,906,899 | 9/1975 | Harpavat | 118/637 |
| 4,043,298 | 8/1977 | Swackhamer | 118/652 |
| 4,436,055 | 3/1984 | Yamashita et al. | 118/658 |
| 4,571,060 | 2/1986 | Bares | 355/200 |
| 4,616,919 | 10/1986 | Adley et al. | 355/245 |
| 4,697,914 | 10/1987 | Hauser | 355/215 |
| 4,891,673 | 1/1990 | Buell | 355/245 |
| 4,994,863 | 2/1991 | Reynolds | 355/245 X |

*Primary Examiner*—A. T. Grimley
*Assistant Examiner*—P. J. Stanzione
*Attorney, Agent, or Firm*—Denis A. Robitaille

[57] ABSTRACT

An apparatus for sealing a housing to prevent the escape of airborne material therefrom. Carrier beads are captured and suspended in a magnetic field extending across a region adapted to be sealed, forming a curtain of carrier beads for preventing the escape of airborne material, including toner particles, therepast. The carrier bead curtain is continuously collapsed and regenerated as carrier beads are captured, accumulated, and deposited into the housing.

17 Claims, 4 Drawing Sheets

APPARATUS AND METHOD FOR CREATING A DEVELOPER HOUSING SEAL VIA A CURTAIN OF CARRIER BEADS

This invention relates generally to electrostatographic printing apparatus, and more particularly concerns a method and apparatus for preventing the escape of airborne toner particles from a developer housing in an electrophotographic reproducing machine.

Generally, the process of electrophotographic reproduction is executed by exposing a light image of an original document to a substantially uniformly charged photoreceptive member. Exposing the charged photoreceptive member to a light image discharges the photoconductive surface thereof in areas corresponding to non-image areas in the original document while maintaining the charge on the image areas, thereby creating an electrostatic latent image of the original document on the photoreceptive member. This latent image is subsequently developed into a visible image by depositing a charged developing material onto the photoconductive surface of the photoreceptor such that the developing material is attracted to the charged image areas thereon. The developing material is then transferred from the photoreceptive member to a copy sheet on which the image may be permanently affixed to provide a reproduction of the original document. In a final step in the process, the photoconductive surface of the photoreceptive member is cleaned to remove any residual developing material therefrom in preparation for successive imaging cycles.

As part of the development process, developing material which typically includes a mix of carrier beads and very fine dry toner particles, is subjected to considerable movement and agitation within a developer housing, producing a "powder cloud" as carrier beads and the toner particles are mixed or otherwise agitated to produce a triboelectric charge thereon. One of the problems associated with this triboelectrification process is the inadvertent escape of developing material from the developer housing. Airborne toner particles carrying on electrostatic charge are readily attracted to various surfaces within the electrostatographic apparatus outside of the developer housing which can result in the contamination of various processing stations and machine components. Moreover, since the charge on the toner particles is not controlled, escaping toner particles can be developed on the photoreceptor, producing a background image on the reproduction of the original document.

Contamination and powder cloud development caused by the escape of developing material adversely effects copy quality as well as machine reliability and performance. For example, developing material escaping into the body of the machine can collect on a lens, an illuminating lamp, or a minor, causing the exposure of the original document to be decreased dramatically. Furthermore, development of escaping toner particles is a serious contributor to background image forming. These problems are just a few of the difficulties associated with the escape of developing material in electrostatographic printing apparatus yielding non-uniform exposure, increased background, and generally unacceptable copy quality as well as unscheduled maintenance and repair by skilled field service technicians. Thus, it is essential that airborne particles are constrained within the developer housing in an electrostatographic printing apparatus.

Developing material escape and the resultant problems associated therewith are well recognized issues to those of skill in the art of electrostatographic printing. Generally, therefore, a typical developer housing will include a seal or other physical barrier for preventing the migration of developing material outside of the developer housing. However, the peculiar characteristics of developing material and a general requirement for safeguarding the photoconductive surface of the photoreceptive member preclude the use of many configurations or existing materials which might otherwise sufficiently prevent the escape of material from the developer housing.

An alternative solution to the problem of developing material contamination has been proposed in which the developer housing is maintained at negative pressure relative to the ambient environment of the reproducing machine to insure that airflow is directed into the developer housing rather than outward therefrom. Typically, devices for providing negative pressure are expensive and require additional space within the electrostatographic apparatus for air ducting. Furthermore, such systems generally require air filters which tend to become obstructed during continued use, requiring replacement by a skilled service technician. These factors combine to yield a significant cost impediment on negative pressure airflow solutions to the problem of developing material contamination.

Another solution to this problem has been provided wherein developing materials have been provided with an additional magnetic component for attracting toner particles to carrier beads so that the toner particles will be prevented from becoming airborne. Although this approach has proven to be effective at reducing the escape of toner particles from the developer housing, the addition of a magnetic component is not always compatible with the materials used in electrostatographic printing apparatus or electrophotographic reproducing processes.

It is generally observed that, even with the use of the foregoing precautions, developing material and other airborne debris tend to escape from the developer housing. Thus, it is highly desirable to provide an efficient and inexpensive system for preventing the escape of developing material from a developer housing. As previously discussed hereinabove, various approaches have been contemplated and devised for addressing the issue of developing material escape to prevent contamination, powder cloud development, and other problems associated therewith. The following disclosures may be relevant to various aspects of the present invention:

U.S. Pat. No. 3,809,012; Patentee: Delvecchio; Issued: May 7, 1974.

U.S. Pat. No. 3,906,899; Patentee: Harpavat; Issued: Sep. 23, 1975.

U.S. Pat. No. 4,571,060; Patentee: Bares; Issued: Feb. 18, 1986.

U.S. Pat. No. 4,616,919; Patentee: Adley et al.; Issued: Oct. 14, 1986.

U.S. Pat. No. 4,697,914; Patentee: Hauser; Issued: Oct. 6 1987.

The relevant portions of the foregoing disclosures may be briefly summarized as follows:

Delvecchio describes a developer housing seal for electrostatographic reproducing apparatus comprising a multiplicity of overlapping resilient deflector vanes projecting in the direction of movement of the photoreceptive drum. The vanes of the seal disclosed therein angularly deflect the carrier beads inwardly toward the developer housing and away from the edges of the seal, thereby reducing the leakage of developer under the seals.

Harpavat discloses a magnetic developer housing seal wherein a magnet attracts developer particles to form a seal between the developer housing and the photoconductive drum. The seal disclosed in that patent is U-shaped to provide a recess for collecting captured magnetic material such that the collected particles form a portion of the seal.

Bares describes an apparatus for sealing a housing to prevent the escape of toner particles therefrom by capturing and softening toner particles such that the toner particles become tacky and additional toner particles stick to the tacky toner particles. In turn, each successive layer of captured toner particles becomes tacky, capturing other toner particles to produce a seal for preventing the escape of toner particles from the housing.

Adley, et al. describe a sealing apparatus located in a non-contact fashion between the photoconductor drum and the magnetic brush roll in a magnetic development device. The seal has a plurality of ridges along its length for creating a differential airflow under the rotating photoconductor drum to prevent toner dust and carrier beads from migrating beyond the end of the photoconductor and the magnetic brush roll.

Hauser discloses a toner containment method and apparatus wherein at least one electrode extends across the width of the imaging surface of a photoreceptor. The electrode is electrically biased to a sufficient magnitude and to a proper polarity relative to the charge on the imaging surface, creating an electric field barrier sufficient to repel charged particles into the developer housing.

In accordance with the present invention, a method and apparatus for preventing the escape of developing material in electrostatographic printing apparatus is provided.

In accordance with one aspect of the present invention, there is provided a sealing apparatus for preventing the escape of airborne material from a housing in an electrophotographic reproducing machine. The apparatus of the present invention includes a magnetic brush roller for transporting developing material including carrier beads and toner particles and further includes a bead pickoff roller for removing carrier beads from a photoconductive surface wherein the magnetic brush developer roller and the bead pickoff roller are disposed sufficiently proximate to one another so as to form a magnetic field therebetween. The magnetic field provides a medium for collecting and suspending carrier beads removed from the magnetic brush roller and retrieved from the photoconductive member to form a curtain of carrier beads therebetween. This curtain of carrier beads prevents the escape of toner particles as well as other airborne particles from the housing.

Pursuant to a particular aspect of the invention, there is provided an apparatus for sealing a housing in an electrophotographic reproducing apparatus to prevent the escape of airborne material, particularly toner particles, therefrom. The housing is adapted to be sealed along a region adjacent to the photoreceptive member by a means for forming a magnetic field including a rotatably mounted magnet extending along the width of the photoreceptive member and positioned proximate to a fixedly mounted magnetic member generating a magnetic field therebetween. This magnetic field provides a means for collecting and supporting carrier beads transported on the fixedly mounted magnetic brush roller as well as those retrieved from the photoreceptive member to create a carrier bead curtain in the region to be sealed.

In a further aspect of the invention, there is provided a method for preventing the escape of airborne particles from a housing. The method includes the steps of generating a magnetic field between a developer roller and a carrier bead pickoff roller and collecting carrier beads from each roller in the magnetic field therebetween. The carrier beads are bridged across the magnetic field to form a curtain between the pickoff roller and the developer roller such that a seal is produced along an exit of the developer housing for confining airborne material therein.

For a better understanding of the invention as well as other aspects thereof, reference is made to the following drawings and description. Further features of the present invention will become apparent as the following description proceeds and upon reference to the drawings, in which.

While the present invention will be described in connection with a preferred embodiment thereof, it will be understood that it is not intended that the invention be limited to this preferred embodiment. On the contrary, the present invention is intended to cover all alternatives, modifications, and equivalents as may be included within the spirit and scope of the invention as defined by the appended claims.

Figure 1:
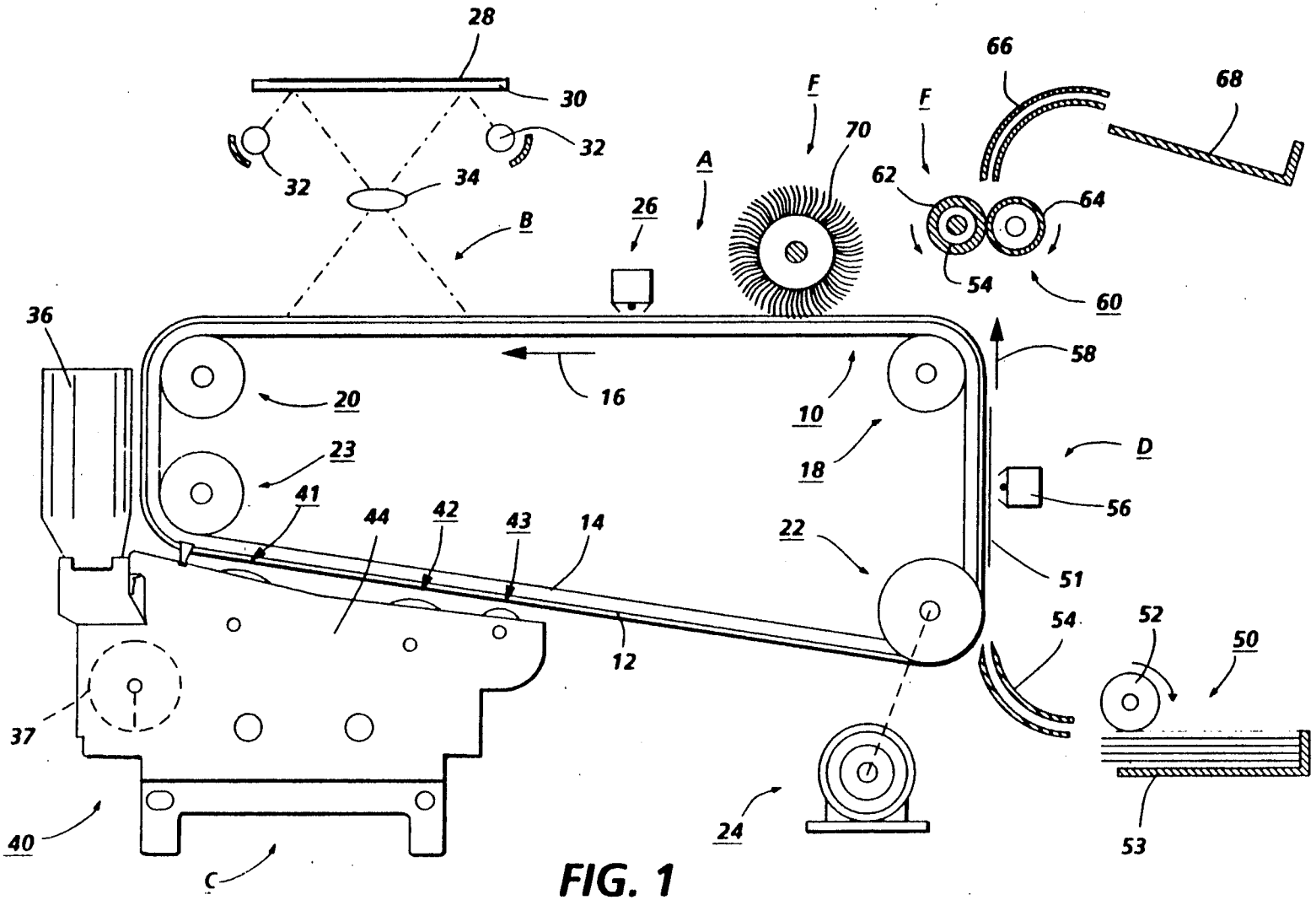
FIG. 1 is a schematic cross-sectional view of an electrophotographic reproducing apparatus incorporating the features of the present invention.

For a general understanding of the features of the present invention, reference is made to the drawings wherein like reference numerals have been used throughout to designate identical elements. Referring now to FIG. 1, a schematic depiction of the various components of an exemplary electrophotographic reproducing apparatus incorporating the sealing apparatus of the present invention is provided. Although the apparatus of the present invention is particularly well adapted for use in an automatic electrophotographic reproducing machine, it will become apparent from the following discussion that the apparatus and method of the present invention is equally well suited for use in a wide variety of electrostatographic printing apparatus and processing machines and is not necessarily limited in its application to the particular embodiment or embodiments shown herein. In particular, it should be noted that the sealing apparatus and method of the present invention described hereinafter with reference to an exemplary development system may also be used in a cleaning subsystem of a typical electrostatographic apparatus since such subsystems may also store toner particles therein and it would be desirable to prevent the escape of developing material therefrom.

The electrophotographic reproducing apparatus of FIG. 1 employs a belt 10 having a photoconductive surface 12 deposited on an electrically grounded conductive substrate 14. Drive roller 22 is coupled to motor 24 by any suitable means, as for example, a drive belt engaging with belt 10 such that belt 10 travels in the direction of arrow 16 about a curvilinear path defined by the drive roller 22, stripping roller 18, and tension rollers 20, 23 which are each rotatably mounted. This system is used for advancing successive portions of photoconductive surface 12 through various processing stations disposed about the path of movement thereof, as will be described.

Initially, a portion of belt 10 passes through charging station A. At charging station A, a corona generating device, indicated generally by reference numeral 26, charges photoconductive surface 12 to a relatively high, substantially uniform potential.

Once charged, the photoconductive surface 12 is advanced to exposure station B where an original document 28, positioned face down upon a transparent platen 30, is exposed to a light source, i.e., lamps 32. The light rays forming a light image of the original document are reflected from original document 28 and transmitted through lens 34. Lens 34 focuses the light image onto the charged portion of photoconductive surface 12 to selectively dissipate the charge thereon. This process records an electrostatic latent image corresponding to the original document 28 onto photoconductive surface 12. Although an optical system has been shown and described for forming the light image of the information used to selectively discharge the charged photoconductive surface 12, one skilled in the art will appreciate that a modulated beam of energy (e.g., a laser beam) may be used to irradiate the charged portion of the photoconductive surface for recording the latent image thereon.

After the electrostatic latent image is recorded on photoconductive surface 12, belt 10 advances to development station C where a magnetic brush development system, indicated generally by the reference numeral 40, deposits developing material onto the electrostatic latent image. Toner is mixed with carrier beads in the developer housing 44, creating an electrostatic charge therebetween which causes the toner particles to cling to the carrier beads to form developing material. The developing material is mechanically transported to the photoreceptive surface 12 via developer rollers 41 and 42, where the toner particles are attracted to the photoreceptive surface 12 to develop the latent image thereon. Preferably, magnetic brush development system 40 includes two developer rollers 41 and 42 disposed adjacent to one another in developer housing 44. The developer rollers 41, 42 rotate so that each roller respectively forms a magnetic brush having carrier beads and toner particles magnetically attached thereto. As the developing material is brought into contact with the photoconductive surface 12, the latent image thereon attracts the toner particles, forming a toner image on photoconductive surface 12. A toner particle dispenser, indicated generally by the reference numeral 36, furnishes additional toner particles to housing 44.

The developer housing 44 further includes a bead pickoff roller, indicated generally by the reference numeral 43, for removing residual carrier beads which may adhere to the photoconductive surface 12 during development of the electrostatic latent image. The detailed structure of the bead pickoff roller 43 and the operation thereof with respect to the present invention will be described hereinafter with reference to FIGS. 2 and 3.

With continued reference to FIG. 1, after the toner particles have been deposited onto the electrostatic latent image for development thereof, belt 10 advances the developed image to transfer station D. At the transfer station D, a sheet of support material 51 is moved into contact with the toner powder image via sheet feeding apparatus 50. Preferably, sheet feeding apparatus 50 includes a feed roll 52 for rotation while in contact with the uppermost sheet of stack 53 to advance the uppermost sheet from stack 53 into chute 54. Chute 54 directs the advancing sheet of support material into contact with photoconductive surface 12 of belt 10 in a timed sequence so that the developed image thereon contacts the advancing sheet of supporting material at transfer station D. Corona generating device 56 is provided for spraying ions onto the backside of sheet 51 to induce the transfer of the toner from the developed image on photoconductive surface 12 to sheet 51. The sheet 51 is subsequently transported in the direction of arrow 58 for placement onto a conveyor (not shown) which advances the sheet to a fusing station E.

Fusing station E includes a fuser assembly, indicated generally by the reference numeral 60, for permanently affixing the transferred image to sheet 51. Fuser assembly 60 preferably comprises a heated fuser roller 62 and a support roller 64 spaced to receive sheet 51 therebetween. The toner image is thereby forced into contact with fuser roller 62 to fuse and permanently affix the toner image to sheet 51. After fusing, chute 66 directs the advancing sheet 51 to receiving tray 68 for subsequent removal of the finished copy by an operator.

A final processing station, namely cleaning station F, is provided for removing residual toner particles from photoconductive surface 12 after the sheet of support material is separated from belt 10. Cleaning station F includes a rotatably mounted fibrous brush 70 for physically contacting photoconductive surface 12 and removing toner particles therefrom. The toner particles are removed from the photoconductive surface 12 by rotation of brush 70 thereacross. Removed toner particles are stored in a cleaning housing chamber (not shown). Cleaning station F further includes a discharge lamp (not shown) for flooding photoconductive surface 12 with light to dissipate any residual electrostatic charge remaining thereon in preparation for a subsequent imaging cycle.

The foregoing description should be sufficient for purposes of the present application for patent in order to illustrate the general operation of an electrophotographic reproducing apparatus incorporating the features of the present invention. As described, an electrophotographic reproducing apparatus may take to form of any of several well known devices or systems. Variations of specific electrostatographic processing subsystems or processes may be expected without affecting the operation of the present invention.

Figure 2:
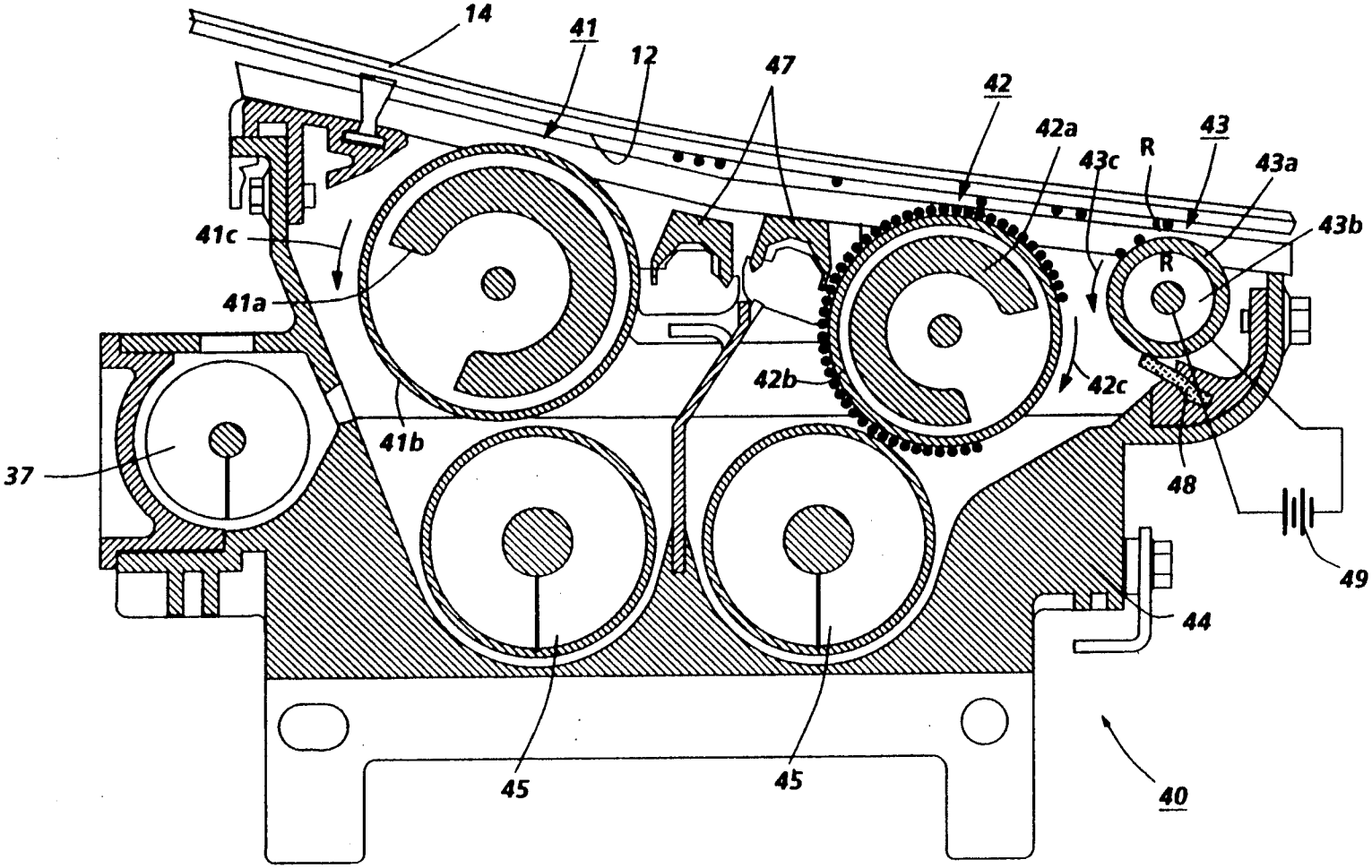
FIG. 2 is a detailed schematic cross-sectional view of the development housing of FIG. 1.

Referring now more particularly to FIG. 2, with continued reference to FIG. 1, and to the specific subject matter of the present invention, an exemplary magnetic brush development system 40 is illustrated and described in greater detail. The primary components of the development system 40 are toner dispenser 36, developer housing 44, mixing augers 45, developer rollers 41 and 42, and bead pickoff roller 43. Toner material stored in toner dispenser 36 is supplied to developer housing 44 via rotating dispensing auger 37. The toner particles supplied to the developer housing 44 are mixed with carrier beads in the developer housing 44 to form the developing material utilized to develop the latent image. Mixing augers 45 are configured to feed developing material in opposite directions, thereby intermixing the toner particles and the carrier beads to induce opposite charges thereon via a process known as triboelectrification, causing the toner particles and carrier beads to b e attracted to one another.

Mixing augers 45 also deliver the developing material to developer rollers 41 and 42 which provide a means for transporting the developing material to the photoreceptor belt 10. Preferably developer rollers 41, 42 each include a fixed magnetic core member 41*a*, 42*a* and a non-magnetic tubular member 41*b*, 42*b*. Tubular members 41*b*, 42*b* have an irregular or roughened exterior surface and are journaled for rotation by suitable means such as ball bearing mounts (not shown). A shaft assembly is concentrically mounted within each tubular member 41*b*, 42*b* to provide a fixed mount for the fixed magnetic cores 41*a*, 42*a*. Developer roller 41 rotates in the direction of arrow 41*c*, counter to the direction of travel of photoconductive surface 12, while developer roll 42 rotates in the direction of arrow 42*c*, in the same direction as photoconductive surface 12. The magnetic field produced by the fixed magnetic cores 41*a*, 42*a* attracts the developer material from the mixing augers 45 onto tubular members 41*b*, 42*b* to transport the developing material into contact with the electrostatic latent image recorded on the photoconductive surface 12. Metering blades 47 are provided to control the amount of developing material transported into contact with the electrostatic latent image.

Figure 3A:
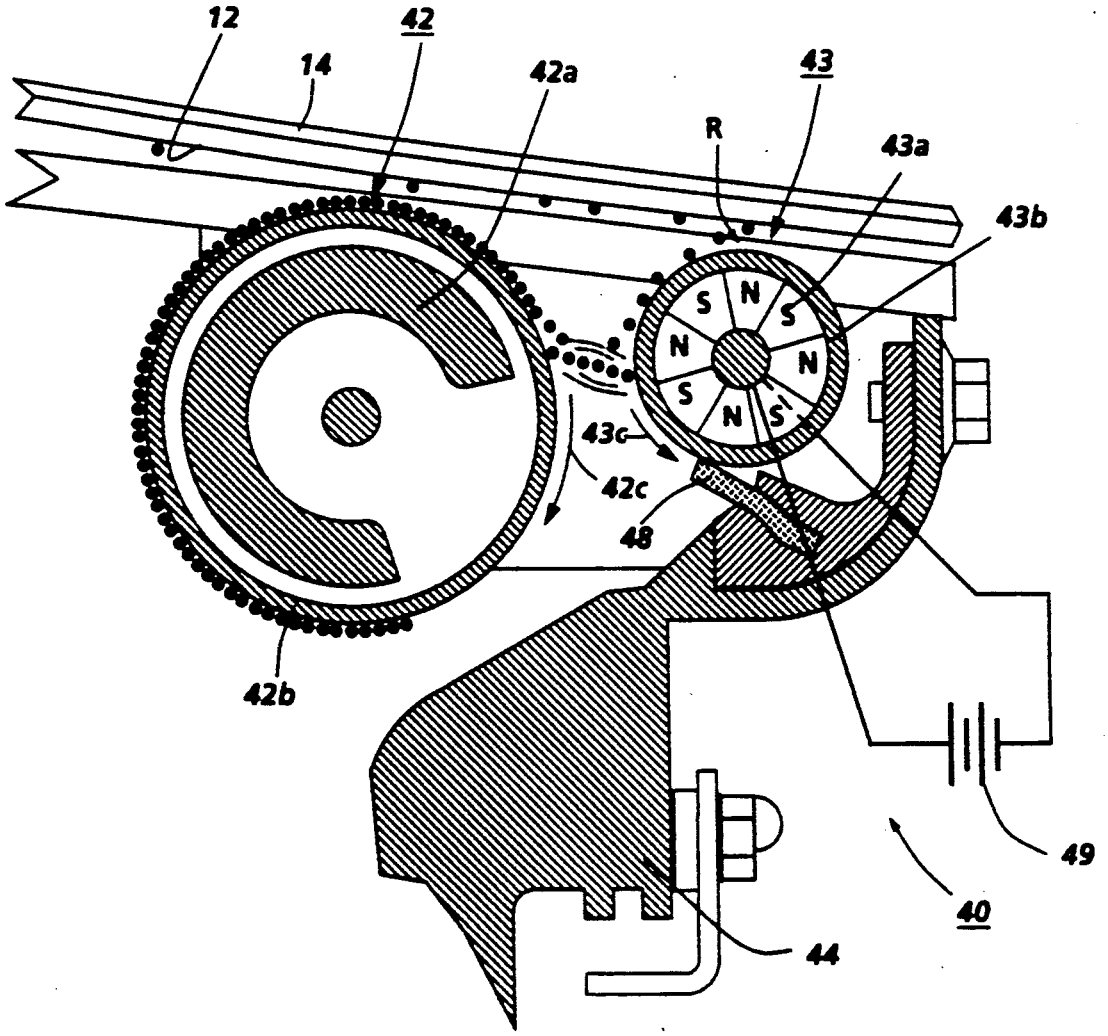
FIGS. 3A and 3B illustrate an enlarged side view of a developer housing showing the developer roller and alternative embodiments of the bead pickoff roller of the present invention having the carrier bead curtain formed therebetween.
Figure 3B:
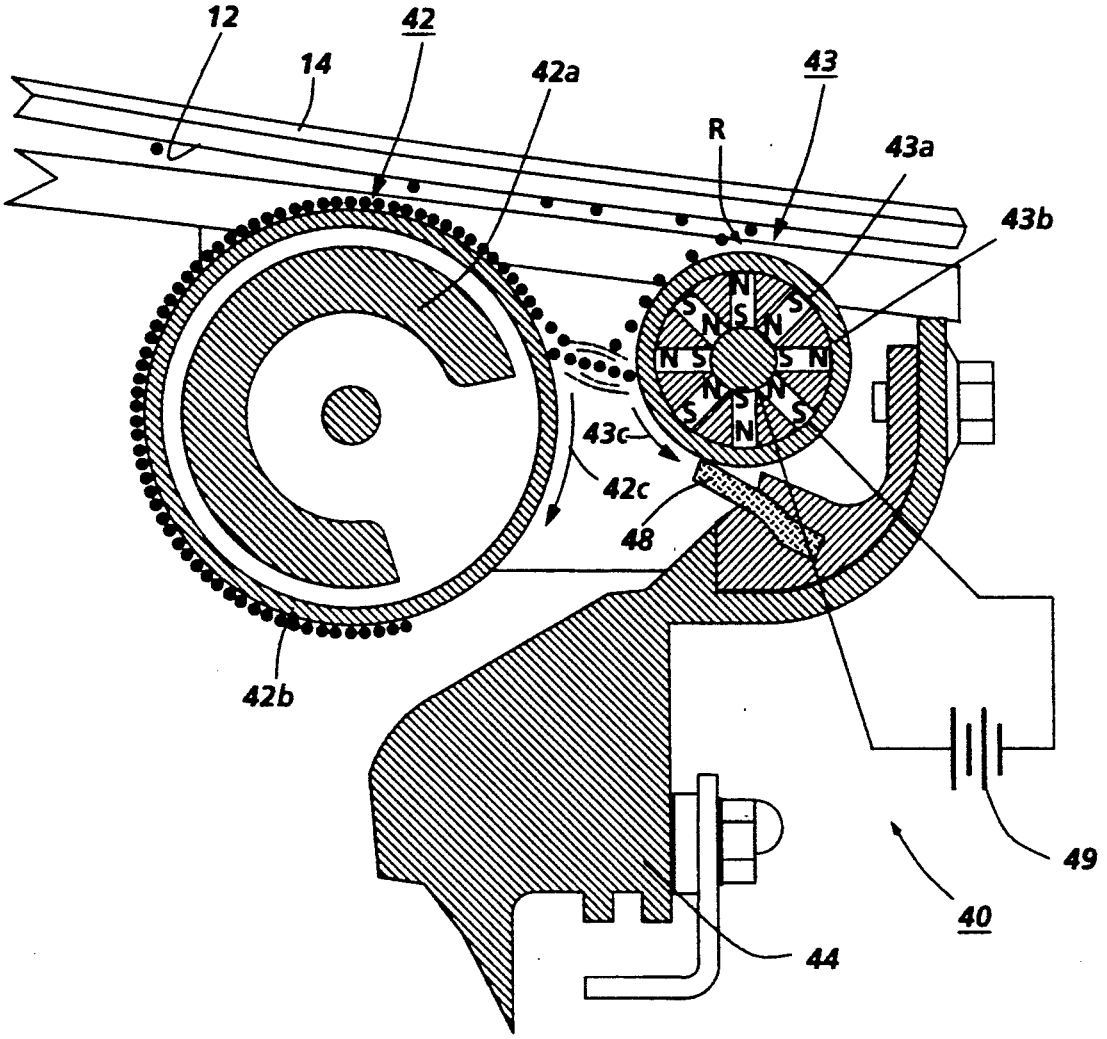

The developer housing 44 of the present invention further comprises a bead pickoff roller 43 extending across the width of the developer housing 44, adjacent to the photoconductive surface 12 and proximate to developer roller 42. Bead pickoff roller 43 provides a means for removing residual carrier beads from photoconductive surface 12. Bead pickoff roller 43 is rotatably mounted for rotation in the direction of arrow 43*c* and is electrically insulated from the developer housing 44 by an insulating plate (not shown). Bead pickoff roller 43 includes a rotatably mounted magnetic member 43*a* disposed within a non-magnetic matrix 43*b* having a high magnetic permeability. The rotatably mounted magnetic member 43*a* includes a plurality of alternating magnetic poles provided by a plurality of bar magnets as shown in FIG. 3B or, a multi-pole cylindrical permanent magnet as shown in FIG. 3A. It will be appreciated by one of skill in the art that, or other various magnet configurations can be utilized to provide the means for removing carrier beads disclosed by the present invention. The non-magnetic matrix 43*b* may be formed of any desired non-magnetic material including non-magnetic metals, plastics, glass, rubber, ceramics, or nylon.

As previously indicated, the bead pickoff roller 43 is positioned adjacent to the photoconductive surface 12, providing a carrier bead removal point, generally indicated at R. During the development process, a small amount of carrier beads, represented in FIG. 2 by small circles, may adhere to the photoconductive surface 12 and travel thereon. Magnetic member 43*a* of bead pickoff roller 43 provides a magnetic field to attract and remove the carrier beads from the photoconductive surface 12 and onto the outer surface of the bead pickoff roller 43. Beads attracted to the bead pickoff roller 43 are held on the surface of the non-magnetic matrix 43*b* thereof and carried away from the carrier bead removal point R by rotation of the bead pickoff roller 43. Thus, rotatably mounted magnet 43*a* of the bead pickoff roller 43 generates a magnetic field for removing carrier beads from the photoconductive surface 12, and transporting them along a course away from the photoconductive surface 12. Doctor blade 48 is provided adjacent to the bead pickoff roller 43 for removing carrier beads therefrom as the beads travel along the surface of the bead pickoff roller 43. The removed carrier beads are returned to the developer housing 44 for reuse in the developing process.

Referring now to FIGS. 3A and 3B which show different embodiments of the housing seal of the present invention, rotating magnetic member 43*a* also generates a magnetic field between bead pickoff roller 43 and the fixed magnetic core 42*a* of adjacent developer roller 42. This magnetic field is operative to pull carrier beads off of the surface of the developer roller 42 and the bead pickoff roller 43. The flux lines of the magnetic field generated between the bead pickoff roller 43 and developer roller 42 provide a force sufficient to suspend the carrier beads therebetween. The resultant accumulation of carrier beads between bead pickoff roller 43 and developer roller 42 forms a curtain which provides a seal for preventing the escape of developing material from the developer housing 44.

Bead pickoff roller 43 and the rotating magnetic member 43*a* thereof rotate in such a way that the curtain-creating magnetic field is broken as one pole of the magnetic member 43*a* travels away from an opposite pole of fixed magnetic member 42*a* in developer roller 42. Concurrently, a new curtain-creating magnetic field is formed as a successive pole of the rotating magnetic member 43*a* travels into proximity with the opposite pole of fixed magnetic member 42*a*. It will be recognized by one of skill in the art that the magnetic field between bead pickoff roller 43 and developer roller 42 is of continuously variable strength and intensity as rotating magnetic member 43*a* rotates through its path. The magnetic field generated between the bead pickoff roller 43 and the developer roller 42 provides sufficient magnetic force to attract and support carrier beads only when a pole on a magnetic member 43*a* becomes sufficiently proximate to an opposite pole of magnetic member 42*a*. Conversely, this magnetic field diminishes as the magnetic pole of magnetic member 43*a* travels away from the opposite pole of magnetic member 42*a*. When this field is broken, the carrier beads forming the curtain between the bead pickoff roller 43 and the developer roller 42 are allowed to drop off under their own weight into developer housing 44.

It is apparent from consideration of FIG. 3 that the degree of field concentration between the developer roller 42 and the bead pickoff roller 43 is continuously variable such that a new curtain-forming magnetic field is generated as a pole of the rotatable magnet 43*a* in bead pickoff roller 43 travels sufficiently proximate to an opposite pole of fixed magnet 42*a* in developer roller 42. Inasmuch as a bead curtain will hold only a finite amount of developing material, the formation of a new curtain-forming magnetic field is coincident with the collapse of a previous curtain as opposite poles travel away from one another.

Another embodiment of the present invention is contemplated wherein the developer housing 44 is provided with an electrical voltage source 49 which is coupled to the magnetic member 43*a* for producing a biasing voltage across bead pickoff roller 43. A suitable voltage is applied to the magnetic member 43*a* for biasing the bead pickoff roller 43 and the carrier bead curtain to attract developing material thereto, further enhancing the barrier created by the bead curtain. In a preferred configuration of this embodiment, the bead pickoff roll is biased to approximately −650 volts, assuming a negative charge on the photoconductive surface.

In recapitulation, it is clear that the apparatus of the present invention provides a seal for preventing the escape of airborne toner particles from a developer housing by forming a curtain of carrier beads along a magnetic field between the bead pickoff roller 43 and an adjacent developer roller 42. The carrier bead curtain provides a seal extending between the developer brush and the pickoff roller. This curtain is continuously destroyed and regenerated as the bead pickoff roller rotates such that a new carrier bead curtain is generated while another carrier bead curtain is collapsed and the accumulation of carrier beads therein is deposited into the reservoir of the developer housing. The foregoing process continues throughout the copy cycle.

It is therefore apparent that a developer housing seal has been provided in accordance with the present invention which fully satisfies the aspects and advantages hereinbefore set forth. While the invention has been described in conjunction with a specific embodiment thereof, it is evident that many alternatives, modifications, and variations will be apparent to those skilled in the art. Accordingly, the present invention is intended to embrace all such alternatives, modifications, and variations which may fall within the spirit and scope of the following claims.

We claim:

1. An apparatus for sealing a housing to prevent the escape of airborne material therefrom, comprising:

means, disposed in said housing, for transporting developing material including at least toner particles and carrier beads; and means, disposed adjacent to a photoconductive surface, for removing carrier beads therefrom, said carrier bead removing means being further disposed proximate to said transporting means such that carrier beads on said transporting means and said carrier bead removing means are captured therebetween to create a seal-forming curtain of carrier beads therebetween.

2. A sealing apparatus according to claim 1, wherein said transporting means includes means for depositing toner particles on the photoconductive surface.

3. A sealing apparatus according to claim 1, wherein said transporting means includes means for removing residual toner particles from the photoconductive surface.

4. A sealing apparatus according to claim 1, further including means for applying an electrical biasing voltage across said carrier bead removing means.

5. An apparatus for sealing a housing to prevent the escape of airborne material therefrom, comprising:

means, disposed in said housing for transporting developing material including at least toner particles and magnetic carrier beads;

means, disposed adjacent to a photoconductive surface, for removing magnetic carrier beads therefrom, said carrier bead removing means being further disposed sufficiently proximate to said transporting means such that magnetic carrier beads on said transporting means and magnetic carrier beads on said carrier bead removing means are captured therebetween to create a seal-forming curtain of carrier beads therebetween, wherein:

said carrier bead removing means includes a rotatably mounted magnetic member for generating a magnetic field between said carrier bead removing means and the photoconductive surface to remove magnetic carrie beads from the photoconductive surface; and said transporting means includes a fixedly mounted magnetic member for generating a magnetic field between said transporting means and said carrier bead removing means to suspend magnetic carrier beads therein so as to create a seal-forming curtain of carrier beads.

6. A sealing apparatus according to claim 5, wherein said rotatably mounted magnetic member includes a plurality of bar magnets, each being disposed such that opposite poles thereof are adjacent one another.

7. A sealing apparatus according to claim 5, wherein said rotatably mounted magnetic member includes a cylindrical multi-pole magnet.

8. A sealing apparatus according to claim 5, wherein said carrier bead removing means further includes a non-magnetic matrix for encasing said rotatably mounted magnetic member therein.

9. An electrophotographic printing apparatus having at least one housing for storing material including at least toner particles therein, said at least one housing comprising:

means, disposed adjacent to a photoconductive surface, for transporting developing material including at least toner particles and carrier beads; and means for removing carrier beads from the photoconductive surface, said carrier bead removing means being disposed proximate to said transporting means so that carrier beads on said transporting means and said carrier bead removing means are captured therebetween to form a curtain of carrier beads therebetween.

10. A sealing apparatus according to claim 9, wherein said transporting means includes means for depositing toner particles on the photoconductive surface.

11. A sealing apparatus according to claim 9, wherein said transporting means includes means for removing residual toner particles from the photoconductive surface.

12. A sealing apparatus according to claim 9, further including means for applying an electrical biasing voltage across said carrier bead removing means.

13. An electrophotographic printing apparatus having at least one housing disposed adjacent to a photoconductive surface for storing developed material including at least toner particles and magnetic carrier beads therein, said at least one housing comprising:

means for transporting the developing material;

means for removing carrier beads from the photoconductive surface, said carrier bead removing means being disposed sufficiently proximate to said transporting means so that magnetic carrier beads on said transporting means and magnetic carrier beads on said carrier bead removing means are captured therebetween to form a curtain of carrier beads therebetween, wherein:

said carrier bead removing means includes a rotatably mounted magnetic member for generating a magnetic field between said carrier bead removing means and the photoconductive surface to attract magnetic carrier beads from the photoconductive surface; and said transporting means includes a fixedly mounted magnetic member for generating a magnetic field between said transporting means and said carrier bead removing means to suspend magnetic carrier beads therein, so as to create a seal-forming curtain of carrier beads.

14. A sealing apparatus according to claim 13, wherein said rotatably mounted magnetic member includes a plurality of bar magnets, each being disposed such that opposite poles thereof are adjacent one another.

15. A sealing apparatus according to claim 13, wherein said rotatably mounted magnetic member includes a cylindrical multi-pole magnet.

16. A sealing apparatus according to claim 13, wherein said carrier bead removing means further includes a non-magnetic matrix for encasing said magnetic member therein.

17. A method for sealing a housing to prevent the escape of airborne material therefrom, comprising the steps of:

transporting developing material, including at least toner particles and carrier beads, on a magnetic roller to a photoconductive surface;

removing carrier beads from the photoconductive surface on a bead pickoff roller; and generating a magnetic field across a region to be sealed between the magnetic roller and the bead pickoff roller so as to attract carrier beads from both the magnetic roller and the bead pickoff roller into the magnetic field to form a curtain of carrier beads therein.

* * * * *